US011408260B2

(12) United States Patent
Wiltse et al.

(10) Patent No.: US 11,408,260 B2
(45) Date of Patent: Aug. 9, 2022

(54) HYBRID HYDRAULIC GAS PUMP SYSTEM

(71) Applicant: Lift Plus Energy Solutions, Ltd., Calgary (CA)

(72) Inventors: Darren James Wiltse, Calgary (CA); David Hall, Calgary (CA)

(73) Assignee: Lift Plus Energy Solutions, Ltd., Calgary (CA)

( * ) Notice: Subject to any disclaimer, the term of this patent is extended or adjusted under 35 U.S.C. 154(b) by 0 days.

(21) Appl. No.: 16/987,200

(22) Filed: Aug. 6, 2020

(65) Prior Publication Data

US 2022/0042401 A1 Feb. 10, 2022

(51) Int. Cl.

| | |
|---|---|
| ***E21B 43/12*** | (2006.01) |
| ***E21B 47/047*** | (2012.01) |
| ***E21B 34/08*** | (2006.01) |
| ***E21B 34/10*** | (2006.01) |
| ***E21B 47/06*** | (2012.01) |
| ***E21B 47/07*** | (2012.01) |

(52) U.S. Cl.

CPC ..... *E21B 43/129* (2013.01); *E21B 34/08* (2013.01); *E21B 34/10* (2013.01); *E21B 43/122* (2013.01); *E21B 43/123* (2013.01); *E21B 47/047* (2020.05); *E21B 47/06* (2013.01); *E21B 47/07* (2020.05); *E21B 2200/04* (2020.05)

(58) Field of Classification Search

CPC ..... E21B 43/129; E21B 34/10; E21B 43/122; E21B 43/123; E21B 34/08; E21B 47/047; E21B 2200/04; E21B 47/06; E21B 47/07

See application file for complete search history.

(56) References Cited

U.S. PATENT DOCUMENTS

| | | | | |
|---|---|---|---|---|
| 2,678,605 | A * | 5/1954 | Tappmeyer | E21B 43/122 166/54.1 |
| 2,906,207 | A * | 9/1959 | Payne | E21B 43/122 166/54.1 |
| 4,489,779 | A * | 12/1984 | Dickinson | E21B 43/129 166/105 |
| 7,823,648 | B2 * | 11/2010 | Bolding | E21B 34/105 166/375 |
| 10,858,921 | B1 * | 12/2020 | Juenke | E21B 34/10 |
| 2006/0289536 | A1 * | 12/2006 | Vinegar | E21B 43/12 219/772 |
| 2016/0273286 | A1 * | 9/2016 | Britton | E21B 21/01 |

* cited by examiner

*Primary Examiner* — Jonathan Malikasim

(74) *Attorney, Agent, or Firm* — The Kubiak Law Firm, PLLC

(57) ABSTRACT

A hybrid hydraulic gas pump system includes a hydraulic gas pump installed on the lower end of a production tubular where the production tubular incorporates a gas lift system. The hydraulic gas pump may be operated using the same gas in the annular region as the gas lift system or may be operated using an independent supply line where the independent supply line is concentric with, or at least within, the production tubular. In some instances, the gas pump chamber may simply be an upper packer including a pickup tube, a check valve, and a pressurized gas supply line or other pressurized gas access mechanism along with a lower packer including a check valve. Each upper and lower check valve allows fluid to flow from below the packer to above the packer.

8 Claims, 14 Drawing Sheets

HYBRID HYDRAULIC GAS PUMP SYSTEM

BACKGROUND

At the present time, it is common to permit oil and gas wells to flow under their own natural pressure for as long as they will do so. When the natural flow of fluid from the well has ceased or becomes too slow for economical production, artificial production methods are employed. In many cases, it is advantageous, at least during the first part of the artificial production, to employ gas lift. Numerous types of equipment for producing fluid by gas lift are available. Usually, gas is forced into the annular area between the production tubular and casing, through the production tubular, and finally into the fluid in the production tubular. As the fluid in the production tubular becomes mixed with gas, the density of the fluid decreases. As the density of the fluid decreases the column of fluid weighs less which allows the pressure exerted by the formation to push fluid out of the column or wellbore at the surface. However, removing fluid, even a reduced density fluid, from the wellbore continues to rely upon pressure exerted by the formation. Eventually the wellbore pressure will no longer be able to push the reduced density fluid to the surface and out of the well.

In certain oil wells the oil deposits are highly viscous. These are usually referred to as heavy oil deposits. Heavy oil deposits usually contain high amounts of sand or particulate matter which in combination with heavy oil's high viscosity make such oil deposits essentially immobile and are therefore unable to flow under normal natural drive or primary recovery mechanisms such as gas lift. Steam injection allows heavy oil deposits to be produced. The technique utilizes a second well usually drilled parallel to and relatively close to the first well. A heat source such as steam is placed in the second well in order to heat the well's surroundings, typically a heavy oil deposit. As the heavy oil is heated viscosity of the deposit is reduced allowing the heavy oil to flow towards the first well. Generally, by the heavy oil's viscosity has been reduced to the point where it will flow the heavy oil remains relatively viscous and as previously mentioned include sand or particulate matter. In order to produce such viscous oil and its included particulate matter a hydraulic gas pump may be used. The hydraulic gas pump is able to operate at very low speeds allowing the viscous oil to flow into and through the pump. A hydraulic gas pump, having very few moving parts, allows particulate matter to flow through the pump, material which may otherwise quickly render other pumps inoperable.

SUMMARY

In order to overcome the limited window of operation of a gas lift system it has been found advantageous to utilize a hydraulic gas pump at the lower end of the gas lift system. When formation pressure is no longer sufficient to push the fluids, including the reduced density fluids, out of the well or when fluid flow out of the well is reduced to the point where it is no longer economically feasible to produce the fluids out of the well, a hydraulic gas pump may be actuated to provide the additional pressure to produce the fluid out of the well. The hydraulic gas pump may be used alone or in conjunction with the gas lift system to lift fluid out of the well.

It is been found that a hybrid system utilizing a hydraulic gas pump at the lower end of the production tubular coupled with a gas lift system to reduce the density of the fluid is able to utilize a single gas source where the pressure has been optimized so that both systems may operate using the same maximum gas pressure. In such a system typically the lowest gas lift valve is adjacent, or as close as may be practical, to the hydraulic gas pump in order to reduce the required hydraulic gas pump pressure by maximizing the amount of reduced density fluid above the hydraulic gas pump and minimizing the amount of non-reduced density fluid above the hydraulic gas pump. In such a system, both the hydraulic gas pump and the gas lift equipment are installed within the well. In many instances, initially, the gas lift system may be operated independently of the hydraulic gas pump. As the amount of fluid produced at the surface decreases, even with the gas lift system activated, the hydraulic gas pump may be activated to increase the pressure within the production tubular. However, depending upon the well characteristics, the hydraulic gas pump may be operated alone, the gas lift system may be operated alone, the hydraulic gas pump and gas lift system may be operated independently of each other but at the same time, or the hydraulic gas pump and the gas lift system may be operated together preferably optimized for maximum efficiency of the combined system.

Generally, in order to optimize either the hydraulic gas pump or the gas lift system, alone or in conjunction with each other, well data is required. For instance, a temperature sensor at the bottom of the well along with a temperature sensor at the top of the well may allow a determination to be made of fluid, cooling from the bottom of the well to the top of the well which in turn relates to viscosity and fluid flow characteristics through the production tubular. In some instances, it may be advantageous to pump relatively rapidly for a period time such as when pumping warmer fluid more quickly to the surface in order to prevent the dissipation of the fluid's heat into the portion of the wellbore not subjected to outside heating, thereby keeping the fluid's viscosity lower than if allowed to cool. The less viscous fluid requires less force to pump the fluid to the surface.

A pressure sensor at the bottom of the well can be used to determine the effectiveness of the gas lift system, the hydraulic gas pump, or the hybrid gas lift/hydraulic gas pump system. When the gas lift system reduces the density of the fluid column the same pressure sensor maybe used to determine when to actuate the hydraulic gas pump to force fluid into the production tubular under pressure such as when the pressure inside of the hydraulic gas pump reaches the formation pressure during a fill portion of the pumping cycle. The hydraulic gas pump may be considered to be "off" while fluids are filling the hydraulic gas pump chamber. At some point, depending upon the pressure that the bottom hole pressure sensor/s detect external gas pressure is allowed into the hydraulic gas pump chamber to "stroke" or force the fluid inside of the hydraulic gas pump chamber into the production tubular. A simple fluid detector may also be utilized to determine whether the fluid chamber of the hydraulic gas pump was full or empty. When the chamber is emptied or reaches a predetermined level the stroke is stopped. If the chamber is full or at a second predetermined level the stroke is initiated. The fluid detector could be a solid-state detector such as checking the electrical resistance of the fluid in certain locations to determine if fluid was present or not or the fluid detector could be mechanical as in a float. In some instances stroke duration and/or initiation may simply operate on a timer.

In previous hydraulic gas pump systems, the hydraulic gas pump was attached to the production tubular along with a parallel gas supply line. The hydraulic gas pump would then be run into the well on the lower end of both production tubular along with a parallel gas supply line. Unfortunately, when the two supply lines are run in parallel deploying the parallel lines is challenging and for safety, a special ram needs to be used in the blowout preventer that will sever both lines. If severed retrieving two lines with severed ends in random locations is difficult. In a current embodiment the production tubular and the gas supply line are run concentrically. If the lines are severed or otherwise disconnected a single trip into the well will allow the operator to retrieve the production tubular retrieves both lines simultaneously.

In an embodiment of the hybrid gas lift system where both a hydraulic gas pump and a gas lift system are utilized both systems may operate off of either the annular supplied gas, production tubing supplied gas, or a separate gas line supplied within the production tubular.

In an embodiment of a hydraulic gas pump a gas pump chamber is formed by placing a first plug having a one-way check in the well at the desired location. The one-way check allows flow to pass through the plug from below the plug to above the plug but prevents flow from above the plug to below the plug. A second plug is then set above the first plug. The second plug includes a tubular that extends below the plug. The tubular includes a one-way check valve that allows fluid to into the tubular from the area below the plug, through the one-way check valve, and through the plug to the area above the plug while preventing fluid from flowing from the area above the plug to the area below the plug. The second plug includes a port to allow gas flow through the plug to the area below the plug. The gas may be provided by a dedicated tubular or may be provided by allowing access to either the annular or tubular area above the plug depending upon where gas is provided, in either the annular or tubular area.

DETAILED DESCRIPTION

The description that follows includes exemplary apparatus, methods, techniques, or instruction sequences that embody techniques of the inventive subject matter. However, it is understood that the described embodiments may be practiced without these specific details.

Figure 1:
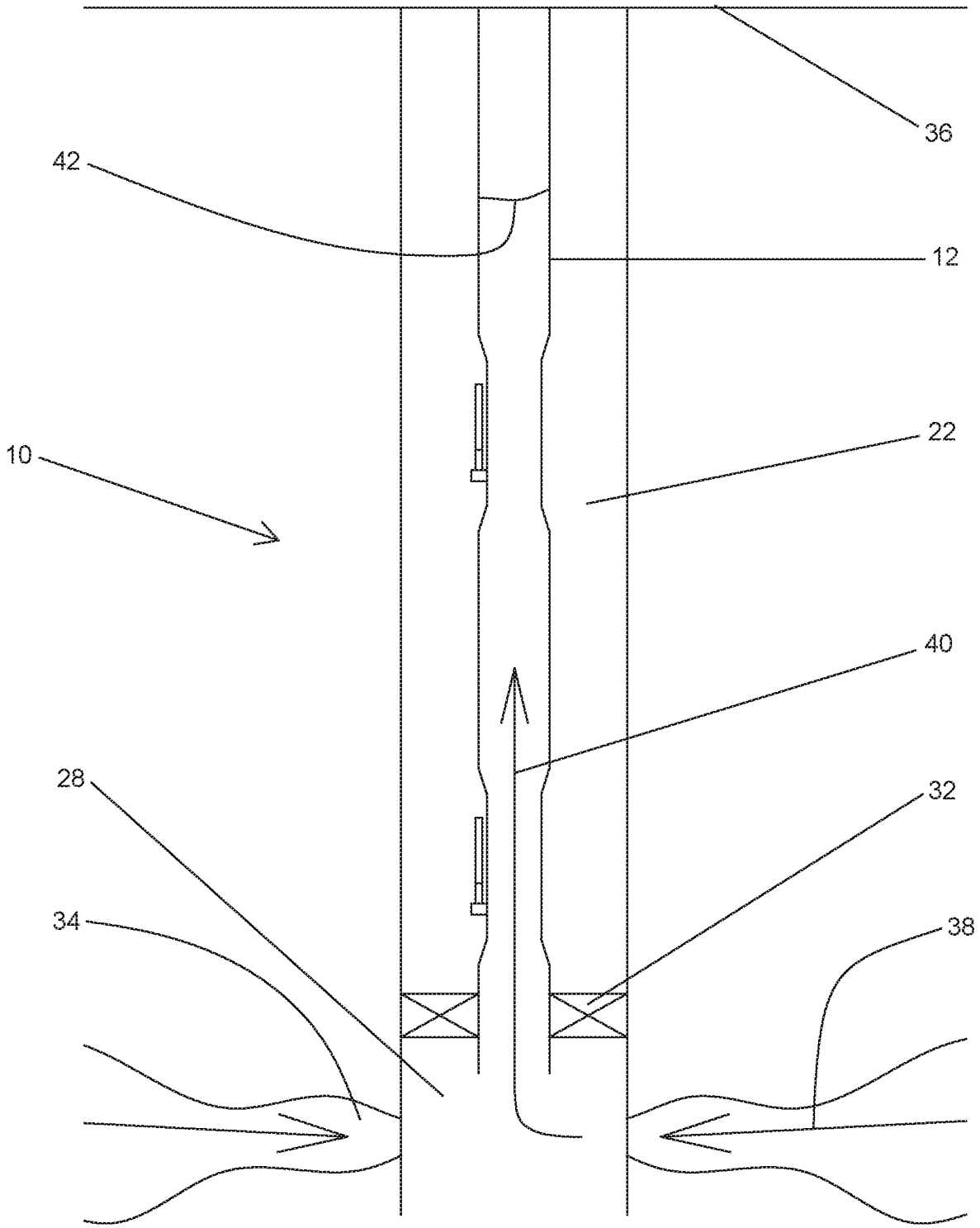
Figure 1 Prior Art
FIG. 1 depicts a prior art gas lift system in place but not in operation.

FIG. 1 depicts a prior art gas lift system 10 with the gas lift system 10 in place but not in operation. Generally, a gas lift system 10 is put into operation when the formation 34 no longer has enough pressure to push wellbore fluids from the formation 34 through the production tubular 12 to the surface 36. In this instance the wellbore fluid flows towards the wellbore 28 as indicated by arrow 38 and is prevented from entering the annular area 22 by packer 32. The wellbore fluid is allowed to flow into the interior of the production tubular 12 as indicated by arrow 40. The wellbore fluid will rise within the production tubular 12 to some point such as is indicated by the liquid/gas interface 42 but cannot rise to the surface 36.

Figure 2:
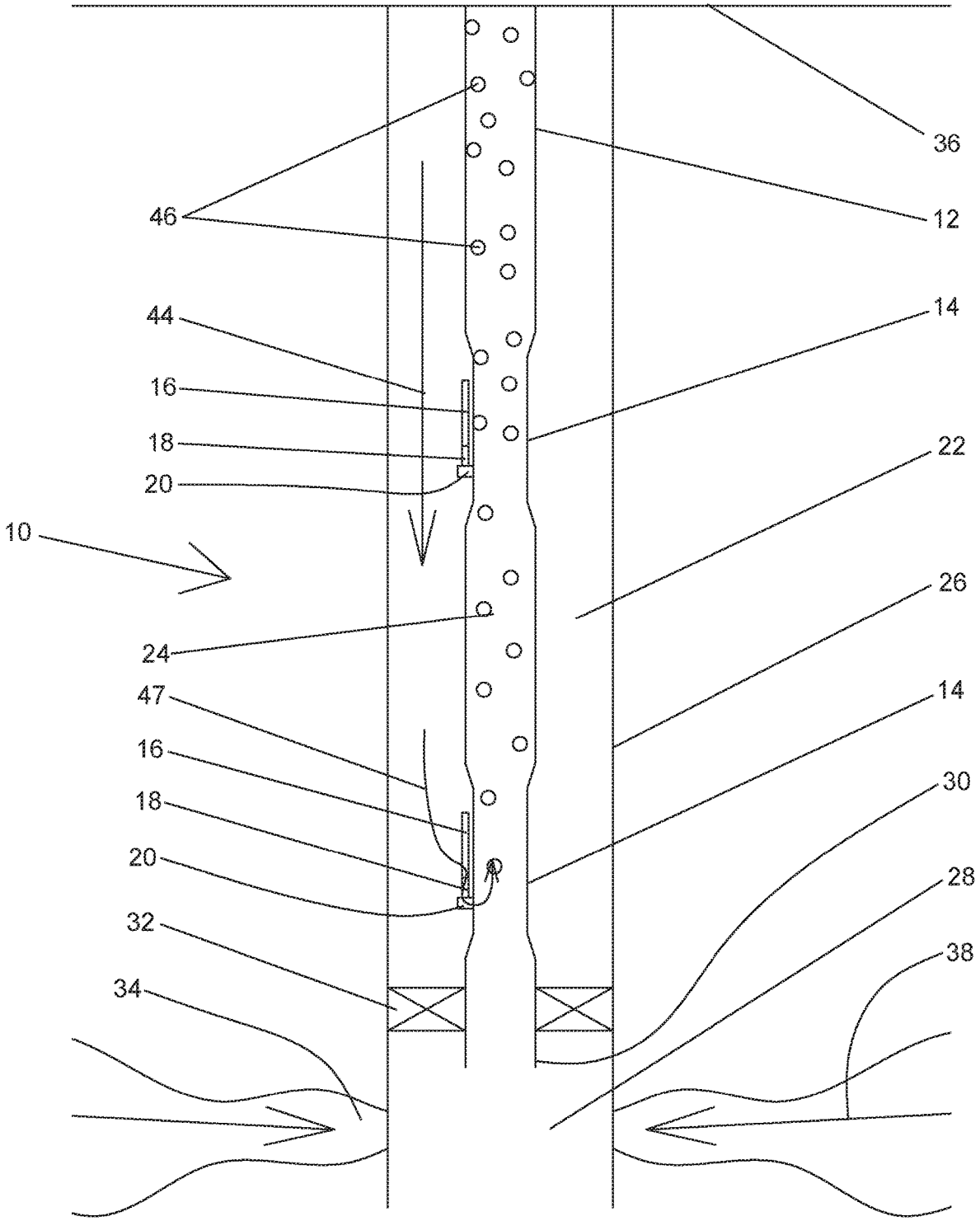
Figure 2 Prior Art
FIG. 2 depicts a prior gas lift system in operation.

FIG. 2 depicts prior art gas lift system 10 with the gas lift system 10 in operation. The gas lift system 10 has a production tubular 12 inserted into the wellbore 28. Interspersed along the production tubular 12 are gas lift mandrels 14. Each of the gas lift mandrels 14 generally includes a gas lift valve 16, a check valve 18, and a lug 20. The lug 20 is welded over a port that provides access between the interior of the gas lift mandrels 14 and the exterior of gas lift mandrel 14. The lug 20 is welded over the port so that the check valve 18 and or gas lift valve 16 may be threaded into the lug 20 allowing gas to flow through the gas lift valve 16 between the annular area 22 and the interior 24 of the production tubular 12. The annular area 22 is the area between the wellbore wall 26 and the exterior of the production tubular 12. The wellbore wall 26 in most instances is cased. A packer 32, if used, may be near the lower end 30 of the production tubular 12. Gas such as nitrogen, carbon dioxide, or natural gas is pumped into the annular area 22 as indicated by arrow 44. The gas then flows into one of the gas lift valves 16, through the gas lift valve 16, through the check valve 18 through the lug 20 and into the interior of a gas lift mandrel 14 as indicated by arrow 47. The gas then creates bubbles 46 which serve to reduce the overall density of the wellbore fluid within the production tubular 12 allowing the formation pressure to push the now reduced density fluid to the surface 36.

Figure 3:
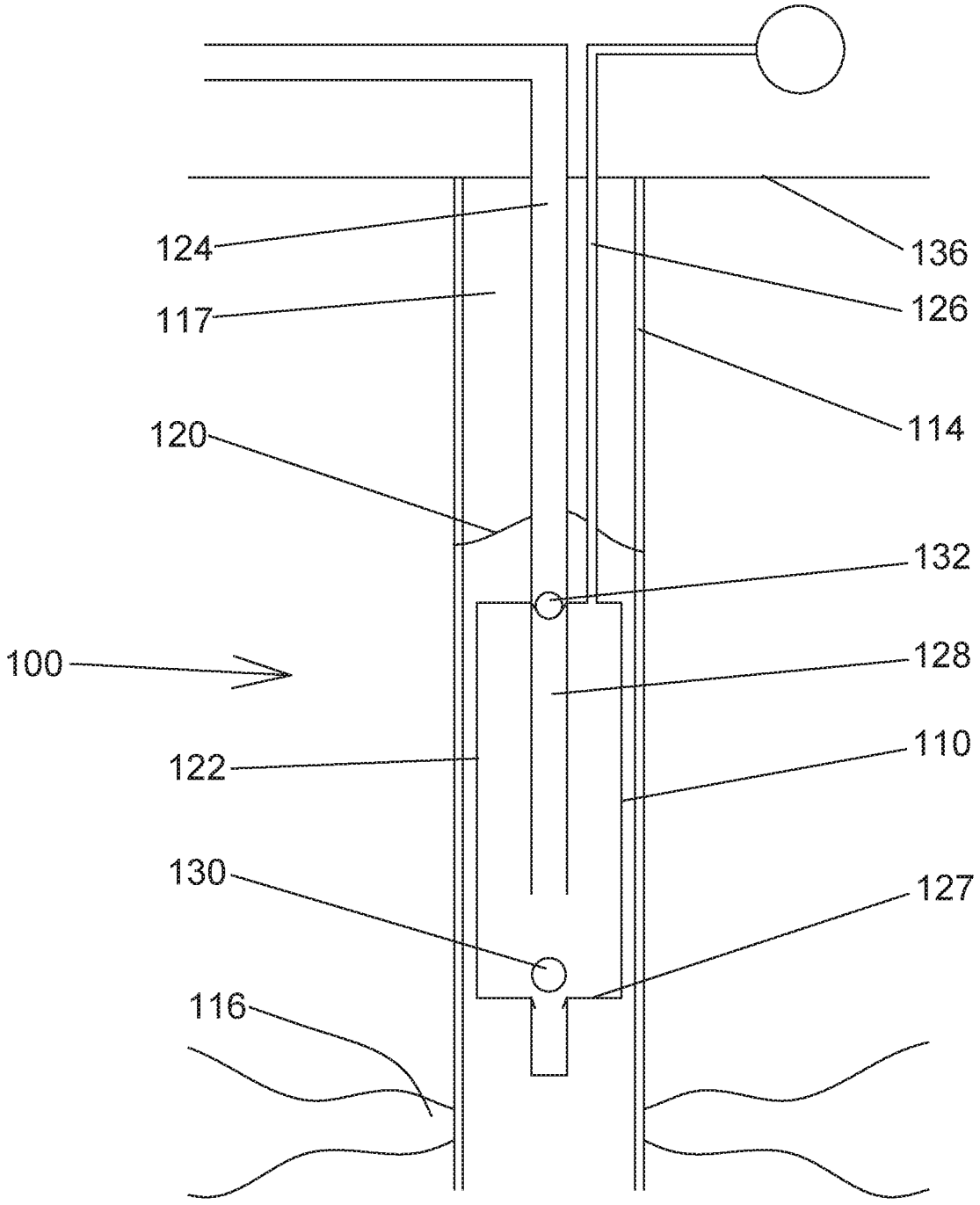
Figure 3 Prior Art
FIG. 3 depicts a prior art hydraulic gas pump system in place within a wellbore.

FIG. 3 depicts a prior art hydraulic gas pump system 100 in place within a wellbore 110. The wellbore 110 has a casing 114, the formation 116 provides fluid that flows into the interior 117 of the wellbore 110 and continues towards the surface 136 until the column of fluid within the wellbore 110 exerts sufficient downward pressure to balance the pressure at the formation 116. Once the pressure exerted by the column of fluid equals the pressure at the formation 116 the column of fluid stops rising at the fluid/gas interface 120. Usually the hydraulic gas pump chamber 122 is placed well below the fluid gas interface 120 so that the entire chamber 122 is submerged within the fluid. The chamber 122 is attached to the lower end of a production tubular 124 and to a parallel gas supply line 126. Within the chamber 122 is a tube 128 that extends towards the lower end 127 of the chamber 122. At the lower end of chamber 122 is a check valve 130 that allows fluid to flow into the chamber 122 from the exterior to the interior of chamber 122 but does not allow fluid to flow from the interior of chamber 122 to the exterior of chamber 122. Chamber 122 has a second check valve 132. Fluid may flow from the interior of chamber 122 into tubular 128 and through check valve 132 to enter into production tubular 124. The second check valve 132 allows fluid to flow from chamber 122 into production tubular 124 but does not allow fluid to flow from production tubular 124 back into chamber 122. The gas supply line 126 is attached chamber 122 so that pressurized gas from the gas supply line 126 may intermittently enter into the interior of chamber 122 displacing fluid from chamber 122.

The hydraulic gas pump system 100 is in the fill cycle of an effective stroke of the hydraulic gas pump system 100. The gas supplied through gas supply line 126 is off, check valve 132 is closed so that fluid may not enter chamber 122 from the production tubular 124, while check valve 130 is open allowing fluid from the exterior of chamber 122 to enter into the interior of chamber 122 through the now open check valve 130. As seen in FIG. 3 chamber 122 is relatively full of fluid.

Figure 4:
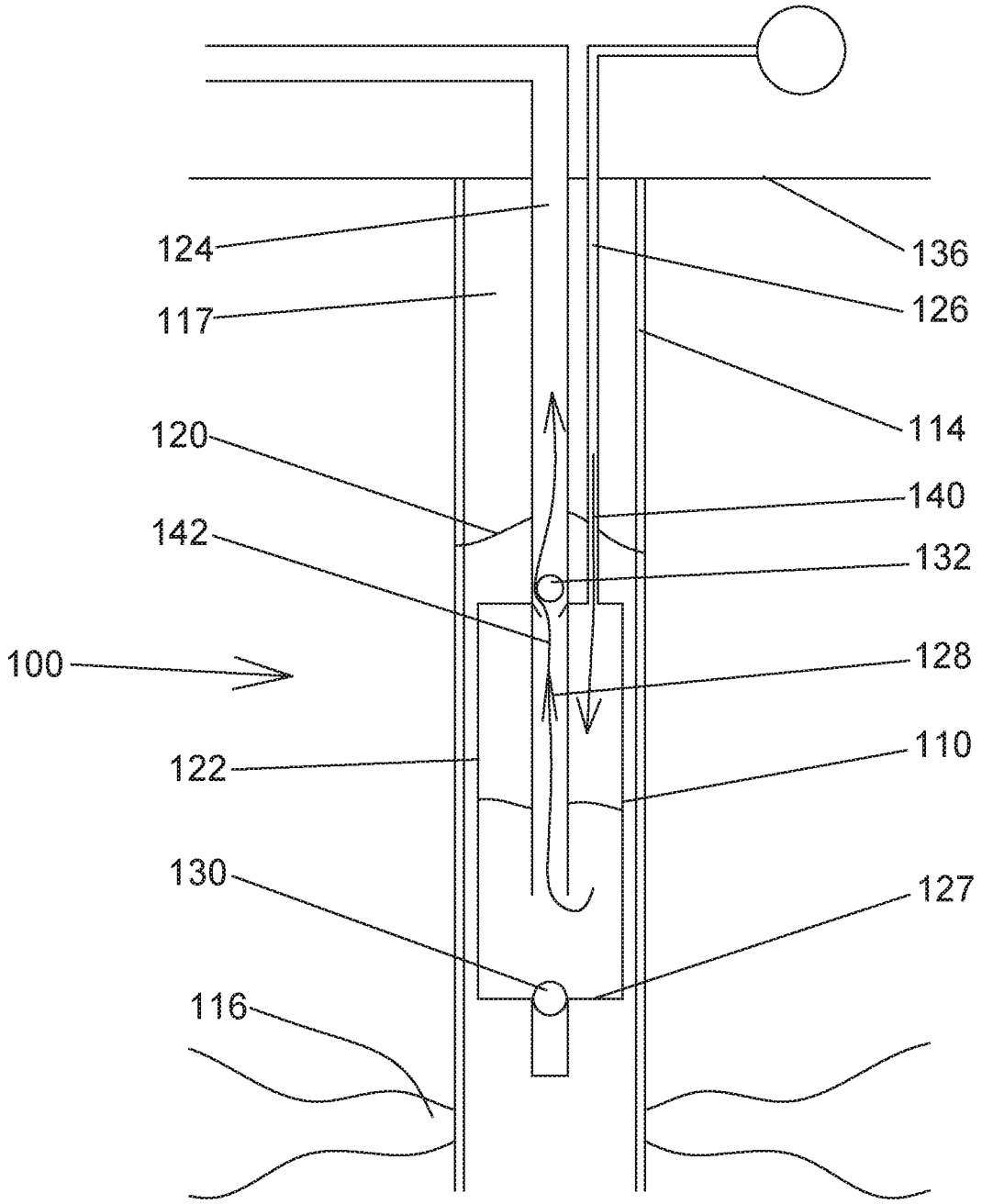
Figure 4 Prior Art
FIG. 4 depicts a portion of the displacement cycle, or stroke, of a hydraulic gas pump system.

FIG. 4 depicts a portion of the displacement cycle of an effective stroke of the hydraulic gas pump system 100. The gas supply through gas supply line 126 is on allowing high-pressure gas to flow into chamber 122 as indicated by arrow 140. Check valve 130 is now closed so that fluid may not exit from the interior of chamber 122 to the exterior of chamber 122. Check valve 132 is open so that the fluid displaced by the high-pressure gas flowing into the chamber 122 can flow into tubular 128 through check valve 132 and a production tubular 124 as indicated by arrow 142.

Figure 5:
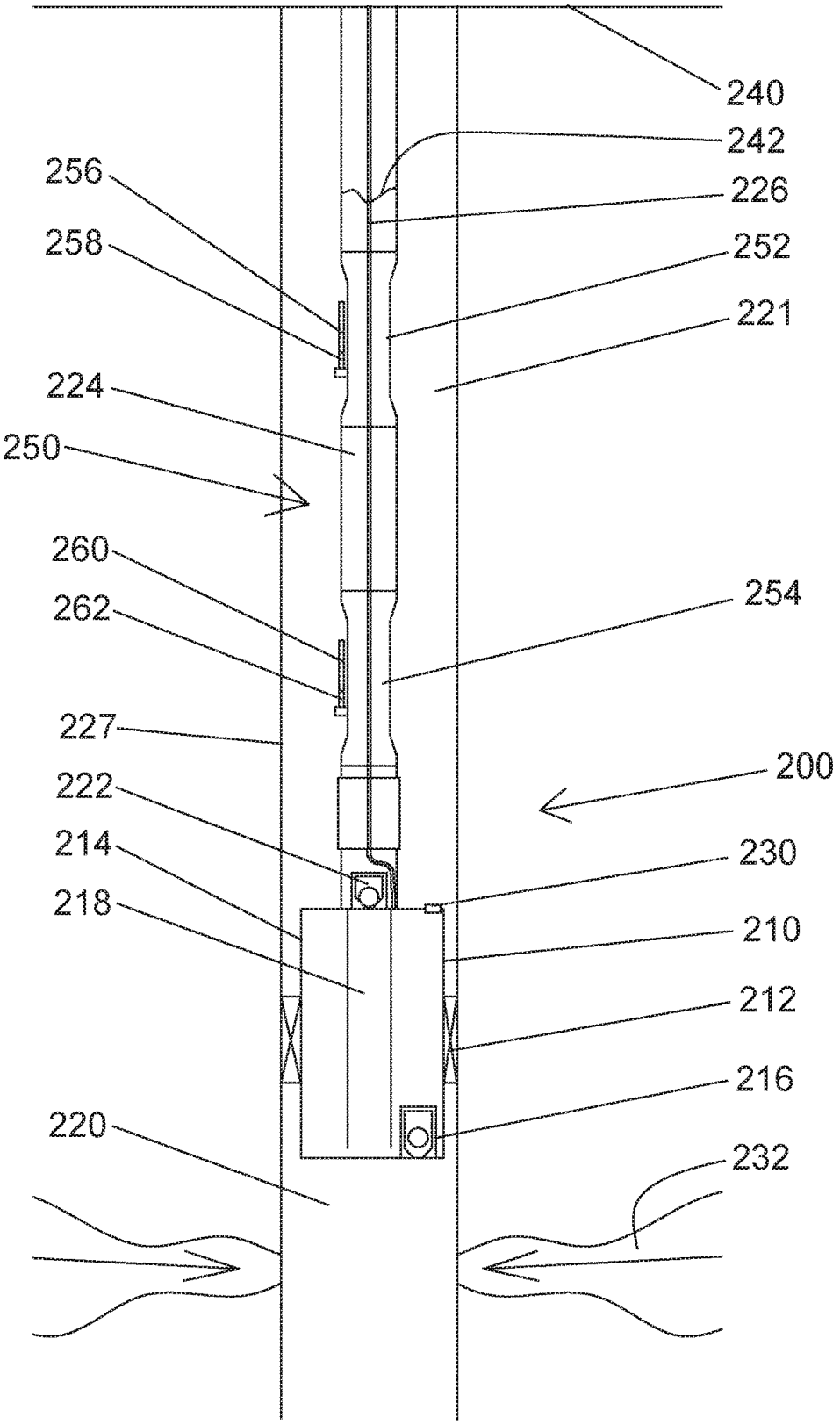
FIG. 5 depicts an embodiment of the hybrid hydraulic gas pump system.

FIG. 5 depicts an embodiment of the hybrid hydraulic gas pump 200. The hybrid hydraulic gas pump 200 includes a hydraulic gas pump 210. Hydraulic gas pump 210 may include a packer such as packer 212. The packer 212 is depicted as being adjacent to the hydraulic gas pump body 214. The packer 212 is depicted as sealing the annular area between the hydraulic gas pump body 214 and the wellbore wall 227. The packer 212 prevents fluid from moving from below the hydraulic gas pump body 214, through the annular area between the hydraulic gas pump body 214 and the wellbore wall 227, to the area above the hydraulic gas pump body 214. In many instances a packer is not used in conjunction with the hybrid hydraulic gas pump 200. Hydraulic gas pump body 214 includes a first check valve 216. The first check valve 216 allows fluid to flow into the interior of the hydraulic gas pump body 214. The first check valve 216 may be a simple caged ball check valve, a spring-loaded check valve, or other valve that operates to allow fluid to flow into the interior of the hydraulic gas pump body and then to close on command such as when gas is being allowed into the interior of the hydraulic gas pump body to force the fluid to the surface. Hydraulic gas pump body 214 usually includes a pickup tube 218.

As shown in FIG. 5 the hydraulic gas pump 210 may be considered either not in operation or on an effective fill cycle. The hydraulic gas pump 210 is generally mounted as close to formation 232 as practical. In certain instances, the hydraulic gas pump 210 would be mounted below the formation 232. By locating the hydraulic gas pump 210 as close to the formation as practical wellbore fluid is able to move from the formation 232 to the interior of the hydraulic gas pump body 214, even in the absence of significant pressure from the formation. Formation fluid moves from the formation to the lower end of the hydraulic gas pump 210. The fluid may then flow into the interior of the hydraulic gas pump body through check valve 216, where check valve 216 allows fluid to move into the interior of the hydraulic gas pump body 214 but prevents fluid from moving from the interior of the hydraulic gas pump body 214 to the exterior of the hydraulic gas pump body 214. As the fluid fills or moves through the interior of the hydraulic gas pump body the fluid will also fill pickup tube 218. Provided there is sufficient pressure from the formation 232 the fluid will continue to move from the pickup tube 218 through the upper check valve 222 and into the production tubular 224. Early in the life of the well pressure from the formation 232 may be sufficient to push the wellbore fluid all the way to the surface 240. However, eventually, pressure in the formation 232 will no longer be sufficient to push fluid to the surface 240 and will only push fluid part way to the surface, in this instance as shown by the gas fluid interface 242.

The hybrid hydraulic gas pump system includes a conventional injection pressure operated gas lift system 250 installed along the length of the production tubular 224 in conjunction with the hydraulic gas pump 210. While a conventional injection pressure operated gas lift system is depicted, any type of gas lift system may be used in conjunction with hydraulic gas pump 210. In this instance a first gas lift mandrel 252 and a second gas lift mandrel 254 are installed as part of the production tubular 224. A first gas lift valve 256 is attached to the first gas lift mandrel 252. Usually, but not always, a gas lift valve has a check valve attached between the gas lift valve in the mandrel. The check valve prevents any fluid or other flow from the interior of the mandrel and/or production tubular towards the check valve in the exterior or the primary annular area 221 between the wellbore wall 227 and the production tubular 224. In this case first check valve 258 is between the first gas the valve 256 and the first gas lift mandrel 252. Also depicted is a second gas lift valve 260, a second gas lift mandrel 254, and a second check valve 262 between the second gas lift valve 260 and the second gas lift mandrel 254. As depicted the wellbore fluid has risen to the fluid gas interface 242 but formation pressure is no longer sufficient to push fluid to the surface 240.

Figure 6:
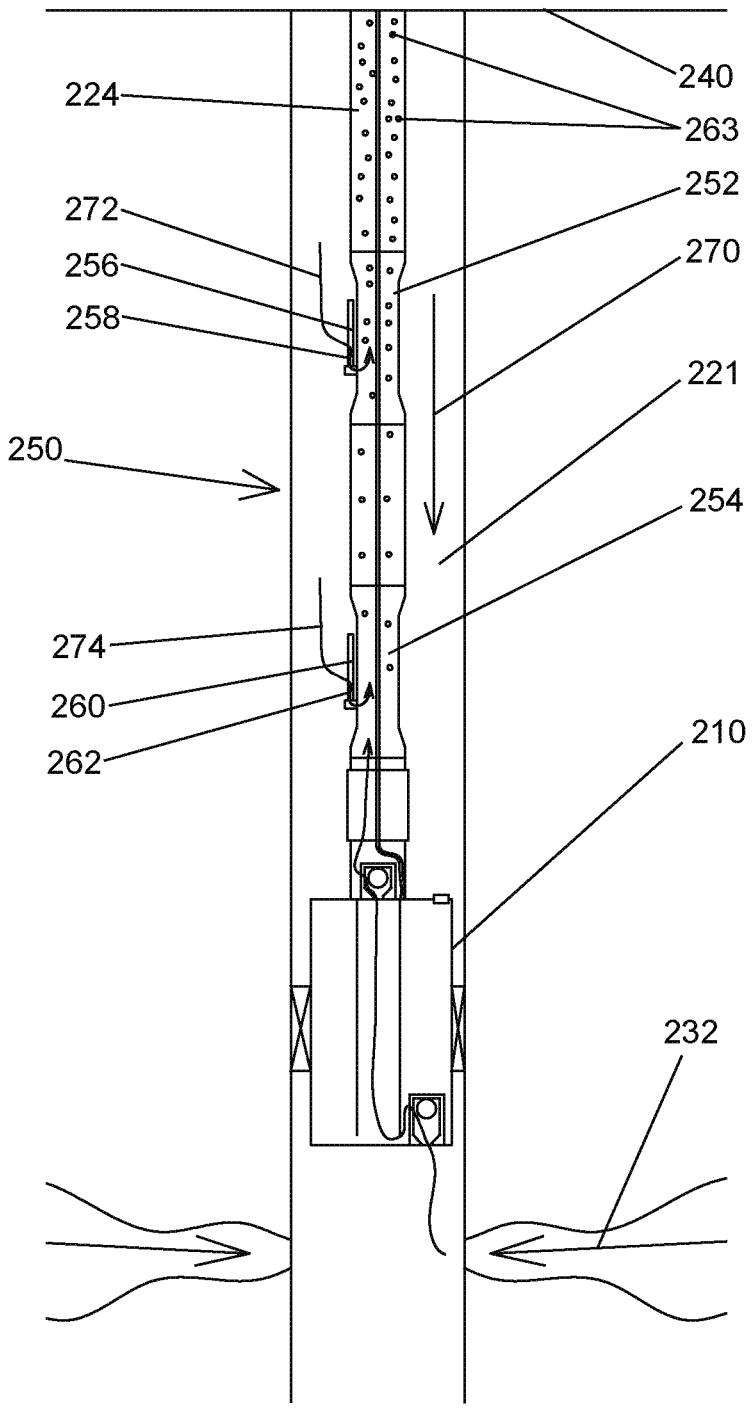
FIG. 6 depicts the gas lift portion of the hybrid hydraulic gas pump system in operation.

FIG. 6 depicts the gas lift 250 portion of the hybrid hydraulic gas pump system in operation. During this initial stage of gas lift the fluid column within the production tubular 224 needs to be lightened in order to allow the formation pressure to push the fluid to the surface 240. Gas is injected into the primary annular area 221 as depicted by arrow 270. As depicted by arrow 272 injected gas flows from the primary annular area 221 through the first gas lift valve 256, through the first check valve 258, and into the interior of the first gas lift mandrel 252. The gas then becomes interspersed within the wellbore fluid, usually in the form of bubbles such as bubbles 263. With the bubbles 263 dispersed within the fluid within the production tubular 224 the overall density of the fluid within the production tubular 224 is reduced allowing the formation pressure to once again push the fluid to the surface 240. In certain instances a single gas lift point such as the first gas lift point provided by first gas lift valve 256, first check valve 258, and the first gas lift mandrel 252 is not able to sufficiently reduce the overall density of the wellbore fluid to allow the fluid to be produced to the surface 240. Usually multiple gas lift points are included along the length of the production tubular 224. A second gas lift point is depicted as being provided by second gas lift valve 260, second check valve 262, and second gas lift mandrel 254. With respect to the second gas lift point, gas flow, as depicted by arrow 274, flows from the primary annular region 221 into the second gas lift valve 260 through the second check valve 262 and into the second mandrel 254 where the gas becomes interspersed within the wellbore fluid.

Eventually formation pressure within reservoir 232 diminishes to the point where the formation pressure is no longer able to push the fluids to the surface even with gas lift reducing the density of the fluid column. It is envisioned that in such an instance a hydraulic gas pump 210 may provide the additional pressure necessary to push the fluid column to the surface 240 in conjunction with the gas lift system 250.

Figure 7:
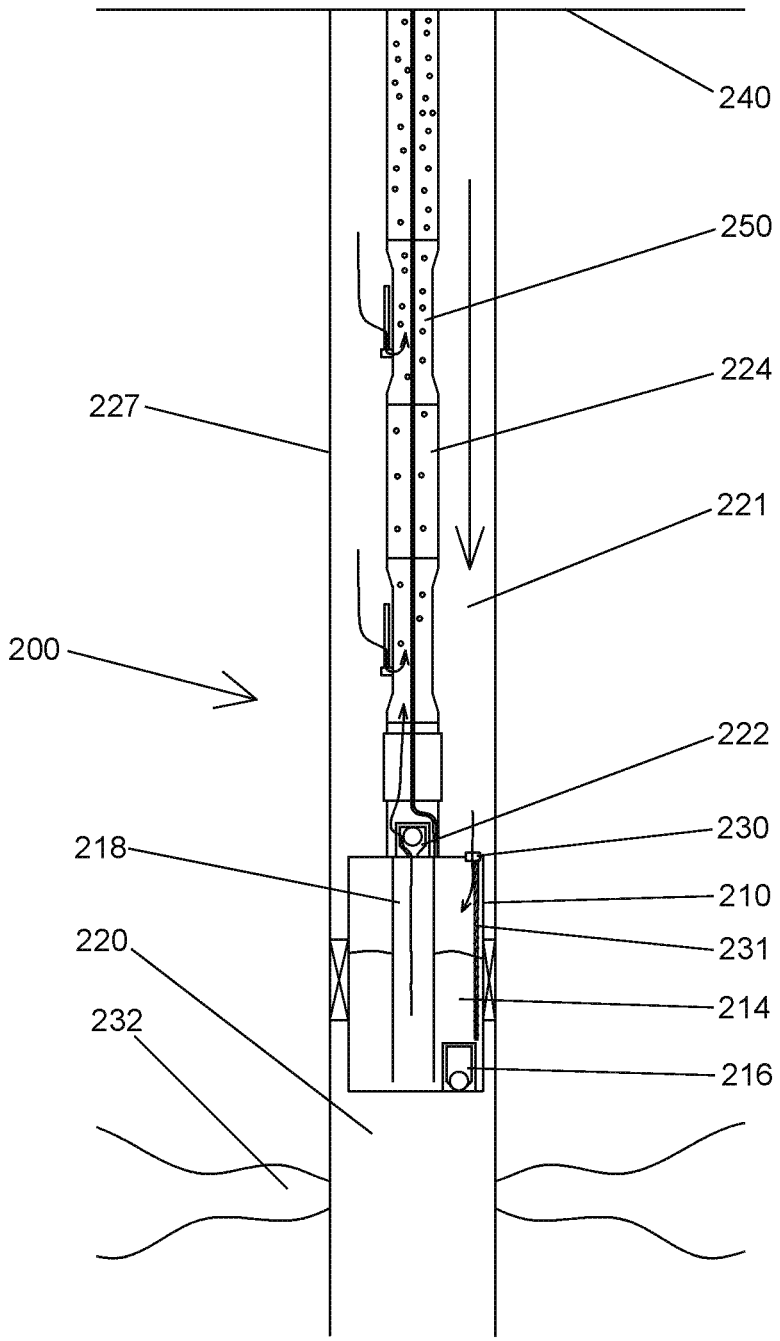
FIG. 7 depicts the hydraulic gas pump system in a mode of operation where the hydraulic gas pump provides the pressure necessary to push the reduced density fluid to the surface.

FIG. 7 depicts the hybrid hydraulic gas pump system 200 in a mode of operation where the hydraulic gas pump 210, replacing the pressure provided by the formation 232, provides the pressure necessary to push the reduced density fluid to the surface 240. In this case the reduced density fluid is being created due to the gas lift system 250 in operation within the wellbore 220. While in certain instances the hydraulic gas pump 210 is capable of providing sufficient pressure to force the wellbore fluid to the surface singly, the use of the gas lift system 250 to reduce the density of the fluid column reduces the overall energy requirements to move the fluids to the surface as the hydraulic gas pump 210 requires less pressure to move the reduced density fluids to the surface as compared to moving the same fluid, but without the injected gas to reduce the density of the fluid, the same distance to the surface. Typically the lowest gas lift point, in this case the gas lift point provided by second gas lift valve 260, second check valve 262, and second gas lift mandrel 254, are placed as close as possible to the hydraulic gas pump 210 in order to minimize the amount of full density wellbore fluid between the hydraulic gas pump 210 and the second gas lift mandrel 254. Any full density fluid within production tubular 224 between gas lift pump 210 and second mandrel 254 increases the weight of the fluid column and thus the pressure required to lift the fluid to the surface 240 and thus increases the amount of energy required to operate the system. The lower the required pressure, the lower the energy cost to lift the fluid to the surface. Generally, the gas pressure is provided by compressors on the surface.

In the hydraulic gas pump 210 mode of operation shown in FIG. 7 the gas supply unit 230 generally includes a valve that opens during the effective pump cycle and closes during the effective fill cycle. The gas supply unit 230 may operate independently downhole or may be operated from the surface. The gas supply unit 230 may operate simply on a timed cycle. The timer may be electrical or mechanical. In some instances, the operation of gas supply unit 230 is based on sensing the fluid level within the hydraulic gas pump body 214. The fluid level may be sensed electrically such as by sensing resistance of the fluid 231 or may be mechanical 233, in FIG. 8, such as having a float within hydraulic gas pump body 214 to trigger the gas supply unit 230 open as the hydraulic gas pump body 214 reaches the desired fill level and then triggering the gas supply unit 230 to close as the fluid level within the hydraulic gas pump body 214 reaches the second desired fill level although any sensing mechanism may be used. With the gas supply unit 230 open, pressurized gas from the primary annular region 221 flows from the primary annular region 221 through the gas supply unit 230 and into the interior of the hydraulic gas pump body 214. The pressurized gas flowing into the hydraulic gas pump body 214 displaces the fluid within the hydraulic gas pump body from the top down. As the fluid is displaced the first check valve 216 will close. As additional pressurized gas enters the hydraulic gas pump body 214 through the gas supply unit 230 the fluid within the hydraulic gas pump body 214 flows into pickup tube 218, through the open second check valve 222 and into production tubular 224 where with the assistance of the gas lift system 250 the fluid is produced to the surface 240. As the hydraulic gas pump body 214 is emptied of fluid the gas supply unit 230 closes in response to the timer, the fluid sensor, or other signal and the cycle is repeated where as depicted in FIG. 6, the gas supply unit 230 is shut off and wellbore fluid is allowed to refill the hydraulic gas pump body 214 through check valve 216.

Figure 8:
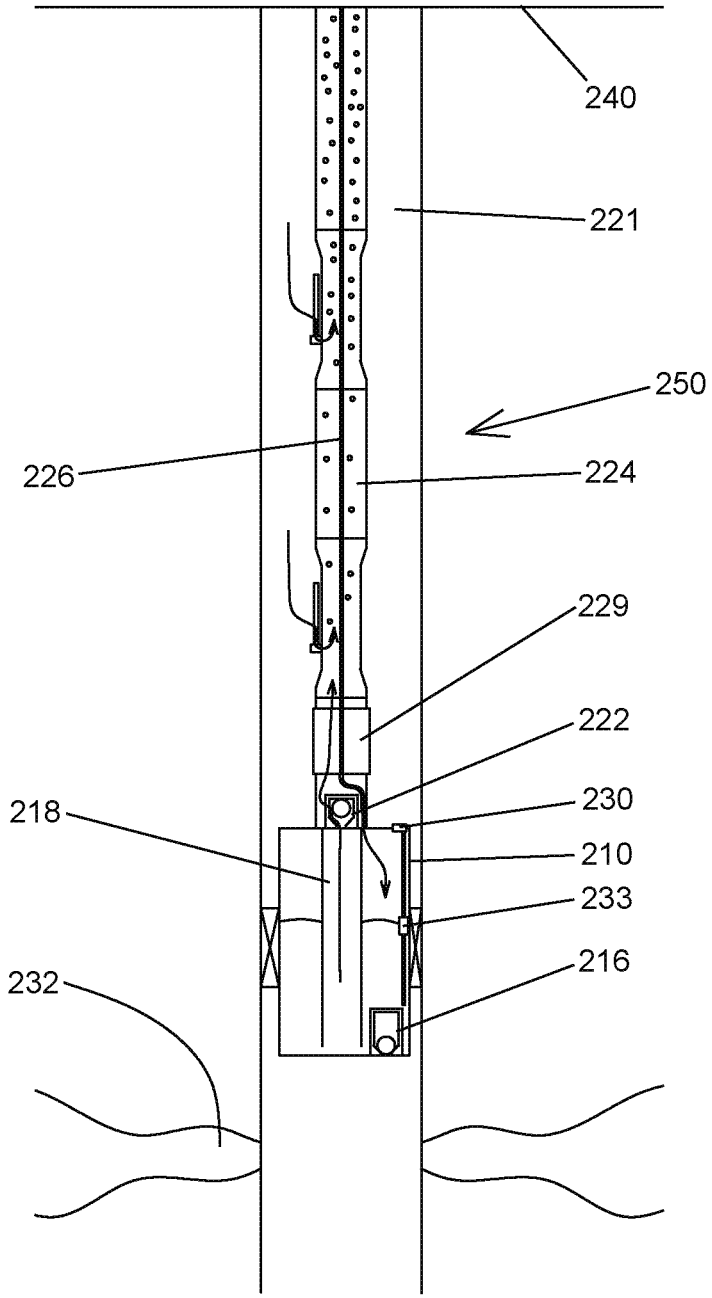
FIG. 8 depicts the hydraulic gas pump without a gas supply unit.

In the hydraulic gas pump 210 second mode of operation shown in FIG. 8 the gas supply unit 230 may or may not be included in the installation. In the second mode of operation pressurized gas is supplied to the hydraulic gas pump 210 via gas supply line 226. Where gas supply line 226 is generally concentric with but is at least within the production tubular 224. As gas supply line 226 reaches coupling 229 the gas supply line 226 enters the hydraulic gas pump 210 and may be routed as necessary within the hydraulic gas pump 210. Generally, the gas supply line 226 provides pressurized gas to the hydraulic gas pump body 214 during the effective pump cycle and the pressurized gas supply ceases during the effective fill cycle. The gas supply line 226 may operate simply on a timed cycle. The timer may be electrical or mechanical. In some instances the operation of gas supply line 226 is based on sensing the fluid level within the hydraulic gas pump body 214. The fluid level may be sensed electrically such as by sensing resistance of the fluid or may be mechanical such as having a float within hydraulic gas pump body 214 to trigger the gas supply line 226 to supply pressurized gas to the hydraulic the gas pump body 214 as the hydraulic gas pump body 214 reaches the desired fill level and then triggering the gas supply line 226 to cease supplying pressurized gas two the hydraulic gas pump body 214 as the fluid level within the hydraulic gas pump body 214 reaches the second desired fill level. With the gas supply line 226 open pressurized gas from the surface 240 flows through the gas supply line 226 and into the interior of the hydraulic gas pump body 214. As the fluid is displaced the first check valve 216 will close. As additional pressurized gas enters the hydraulic gas pump body 214 through the gas supply unit 230 the fluid within the hydraulic gas pump body flows into pickup tube 218, through the open second check valve 222 and into production tubular 224 where with the assistance of the gas lift system 250 the fluid is produced to the surface 240. As the hydraulic gas pump body 214 is emptied of the fluid the gas supply line 226 ceases supplying pressurized gas to the hydraulic gas pump body 214 in response to the timer, the fluid sensor, or other signal and the cycle is repeated where as depicted in FIG. 6, the gas supply line 226 is shut off and wellbore fluid is allowed to refill the hydraulic gas pump body 214 through check valve 216.

Figure 9:
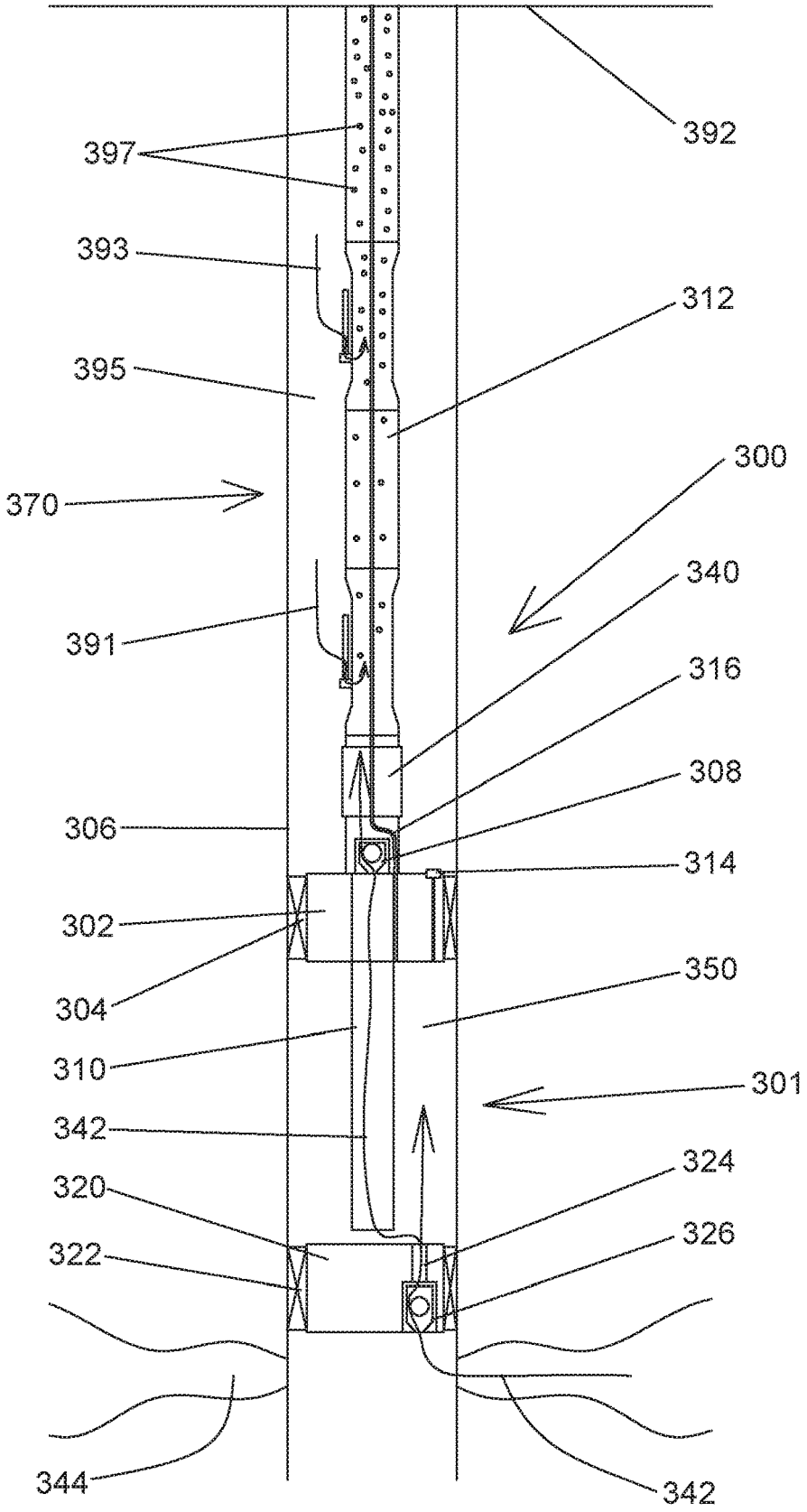
FIG. 9 depicts a hybrid hydraulic gas pump having an upper and lower packer along with a portion of the wellbore forming the hydraulic gas pump chamber.

FIG. 9 depicts an alternative embodiment of a hybrid hydraulic gas pump system 300. The hydraulic gas pump 301 includes a first packer 302. The first packer 302 has a first sealing element 304. The first sealing element 304 provides a gas tight seal between the first packer 302 and the wellbore wall 306. The wellbore wall 306 may be cased or uncased. The first packer 302 includes a pickup tube 310. The first packer 302 also includes a first check valve 308. The first check valve 308 allows one-way fluid flow from pump chamber 350 through the pickup tube 310 to the region above first packer 302. Pickup tube 310 is provided so that fluid at some distance below first packer 302 may flow from the lower end of pickup tube 310, through pickup tube 310, through first packer 302, and through first check valve 308. While check valve 308 is typically provided at the upper end of first packer 302 the check valve 308 may be provided at any point from the lower end of pickup tube 310, through first packer 302, to the top of packer 302. In some instances, the check valve 308 may be provided within production tubular 312. The first packer 302 also includes a gas supply unit 314 and a gas supply line 316 to provide alternate modes of operation. In some instances only a gas supply unit 314 or a gas supply line 316 may be installed in packer 302.

The first packer 302 is coupled to the production tubular 312 via coupling 340. While coupling 340 is depicted as linking the first packer 302 to the production tubular 312 other means of connecting the first packer 302 to the production tubular 312 may be used and include but are not limited to welding and threaded connections.

The hydraulic gas pump 301 includes a second packer 320. The second packer 320 has a second sealing element 322. The second sealing element 322 provides a gas tight seal between the second packer 320 and the wellbore wall 306 to prevent fluid or gas flow past the second packer 320 in either direction. The wellbore wall 306 may be cased or uncased. The second packer 320 also includes a throughbore 324. Throughbore 324 includes a second check valve 326. Second check valve 326 allows fluid to flow from below the second packer 320 through throughbore 324 to the region above second packer 320 while preventing fluid flow from the region above second packer 322 the region below second packer 320.

The first packer 302 is shown having gas supply line 316 extending through and coaxial with production tubular 312. Once the gas supply line 316 reaches the first packer 302 the gas supply line 316 may be routed as necessary through the first packer 302. Alternatively, a gas supply unit 314 is depicted on an upper end of the first packer 302.

The hydraulic gas pump 301 has not been actuated but may be considered to be in a fill stroke. The hydraulic gas pump 301 utilizes the region between first packer 302 and second packer 320 as the pump chamber 350. As depicted by arrow 342 fluid flows from formation 344 toward second packer 320. The fluid then flows past check valve 326 through throughbore 324 and into pump chamber 350. Some fluid fills chamber 350 while a portion of the fluid enters fill tube 310 and proceeds upwards towards packer 302. If sufficient pressure exists within formation 344 the fluid may continue past packer 302 through check valve 308 and into production tubular 312 rising to some point towards the surface past packer 302. Gas is injected into the primary annular area 395. As depicted by arrows 393 and 391 injected gas flows from the primary annular area 395 into the interior of the production tubular 312. The gas then becomes interspersed within the wellbore fluid, usually in the form of bubbles such as bubbles 397. In some instances the formation pressure along with the reduced density of the wellbore fluid provided by gas lift system 370 may be sufficient to produce the fluid to the surface 392. If there is insufficient pressure to produce the fluid to the surface 392 hydraulic gas pump 300 may be actuated.

Figure 10:
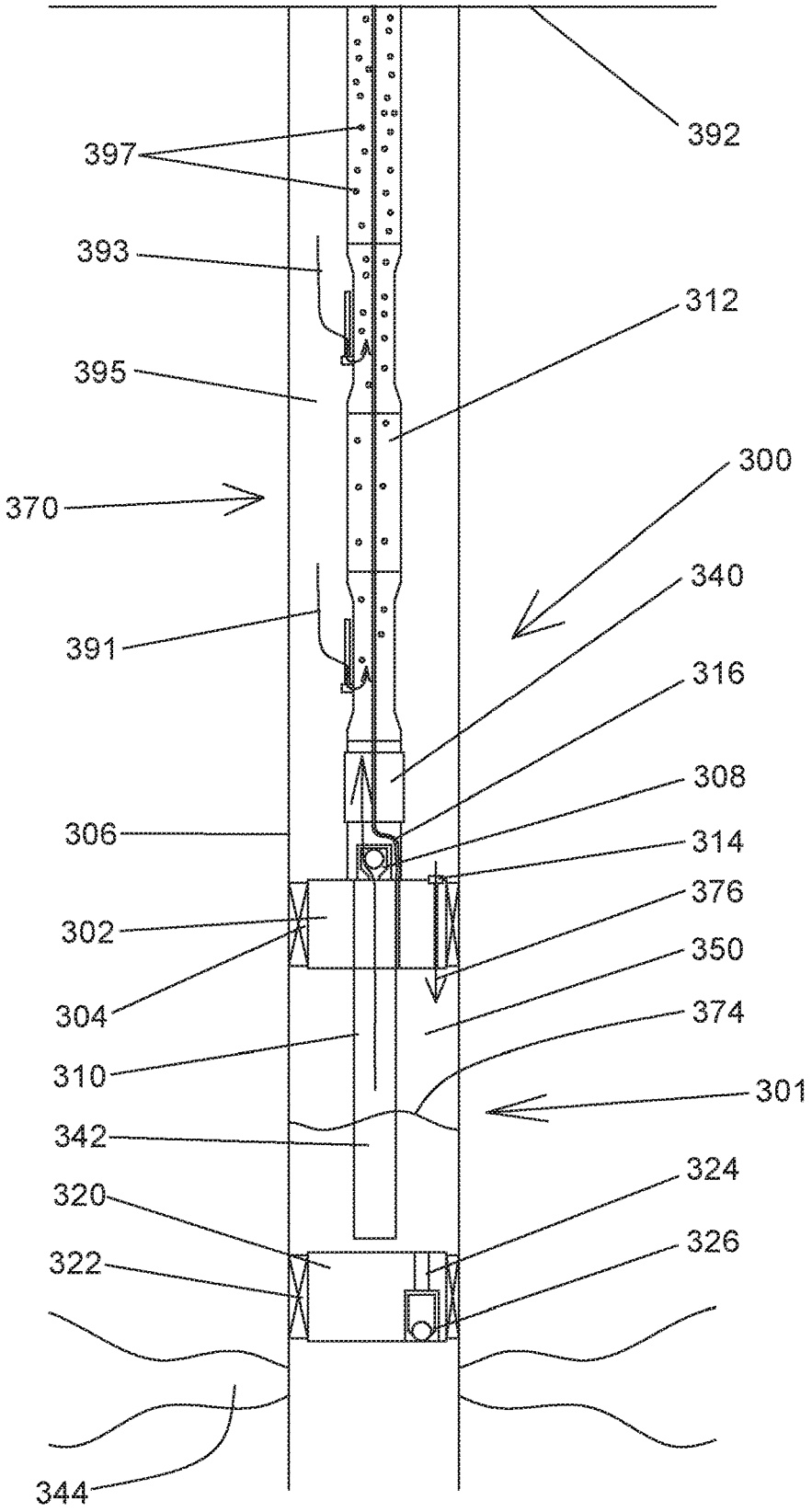
FIG. 10 depicts an alternative embodiment of a hydraulic gas pump providing supplemental pressure to push the reduced density fluid to the surface.

FIG. 10 depicts hybrid hydraulic gas pump system 300 in a mode of operation where the hydraulic gas pump 301, replacing the pressure provided by the formation 344, provides the pressure necessary to push the reduced density fluid to the surface 392. In this case the reduced density fluid is being created due to the gas lift system 370 in operation within the wellbore 306.

In the hydraulic gas pump 300 mode of operation shown in FIG. 10 the gas supply unit 314 generally includes a valve that opens during the effective pump cycle and closes during the effective fill cycle. The gas supply unit 314 may operate independently downhole or may be operated from the surface. With the gas supply unit 314 open, pressurized gas from the annular region 374 flows from the primary annular region 221 through the gas supply unit 230 and into the interior of the hydraulic gas pump body 214.

The pressurized gas flowing into the pump chamber 350 displaces the fluid within the pump chamber 350 such that the gas fluid interface 374 moves lower within the pump chamber 350 from the top down as indicated by arrow 376. As the fluid is displaced the first check valve 308 will open to allow the fluid to move out of the pump chamber 350 and into the production tubular 312 and then towards the surface 392. While the second check valve 326 closes in response to the fluid flow thereby preventing fluid flow out of the pump chamber 350 and back towards formation 344.

As additional pressurized gas enters the gas pump chamber 350 through the gas supply unit 314 the fluid within the gas pump chamber 350 flows into pickup tube 310, through the open first check valve 308 and into production tubular 312 where with the assistance of the gas lift system 370 the fluid is produced to the surface 392. As the gas pump chamber 350 is emptied of fluid the gas supply unit 314 closes and wellbore fluid is allowed to refill the gas pump chamber 350 through check valve 326.

Figure 11:
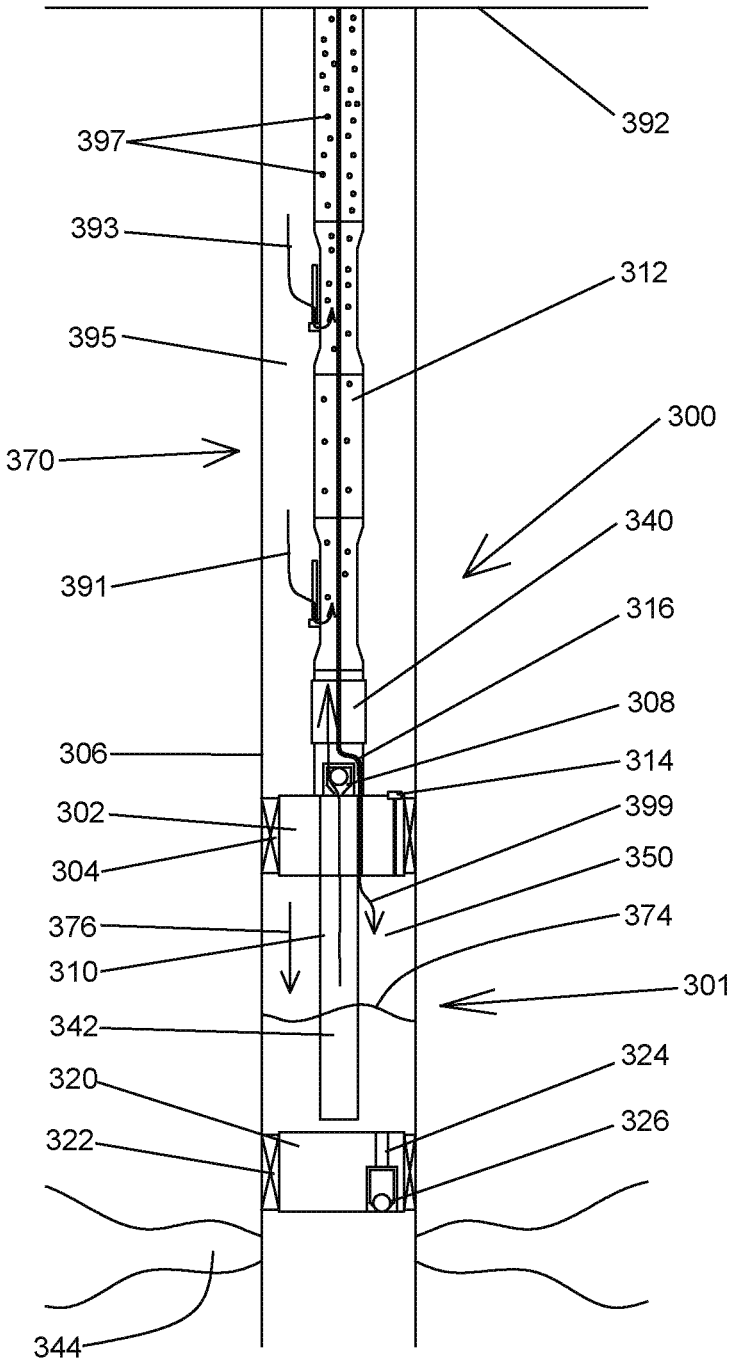
FIG. 11 depicts the hydraulic gas pump utilizing a separate gas supply line within the production tubular.

FIG. 11 depicts the hydraulic gas pump 300 in a second mode of operation. The gas supply unit 314 may or may not be included in the installation. In the second mode of operation pressurized gas is supplied to the hydraulic gas pump 300 via gas supply line 316. Where gas supply line 316 is concentric within production tubular 312. Generally the gas supply line 316 provides pressurized gas to the hydraulic gas pump body 300 during the effective pump cycle and the pressurized gas supply ceases during the effective fill cycle. With the gas supply line 316 open, pressurized gas from the surface 392 flows through the gas supply line 316 and into the gas pump chamber 350 as depicted by arrow 399. The pressurized gas flowing into the gas pump chamber 350 displaces the fluid within the gas pump chamber 350 at the fluid gas interface 374 from the top down. As the fluid is displaced the first check valve 326 closes. As additional pressurized gas enters the gas pump chamber 350 the fluid within the gas pump chamber 350 flows into pickup tube 310, through the open first check valve 308 and into production tubular 312 where with the assistance of the gas lift system 370 the fluid is produced to the surface 392. As the gas pump chamber 350 is emptied of fluid, the gas supply line 316 ceases supplying pressurized gas to the gas pump chamber 350 allowing the gas pump chamber to refill through check valve 326.

Figure 12:
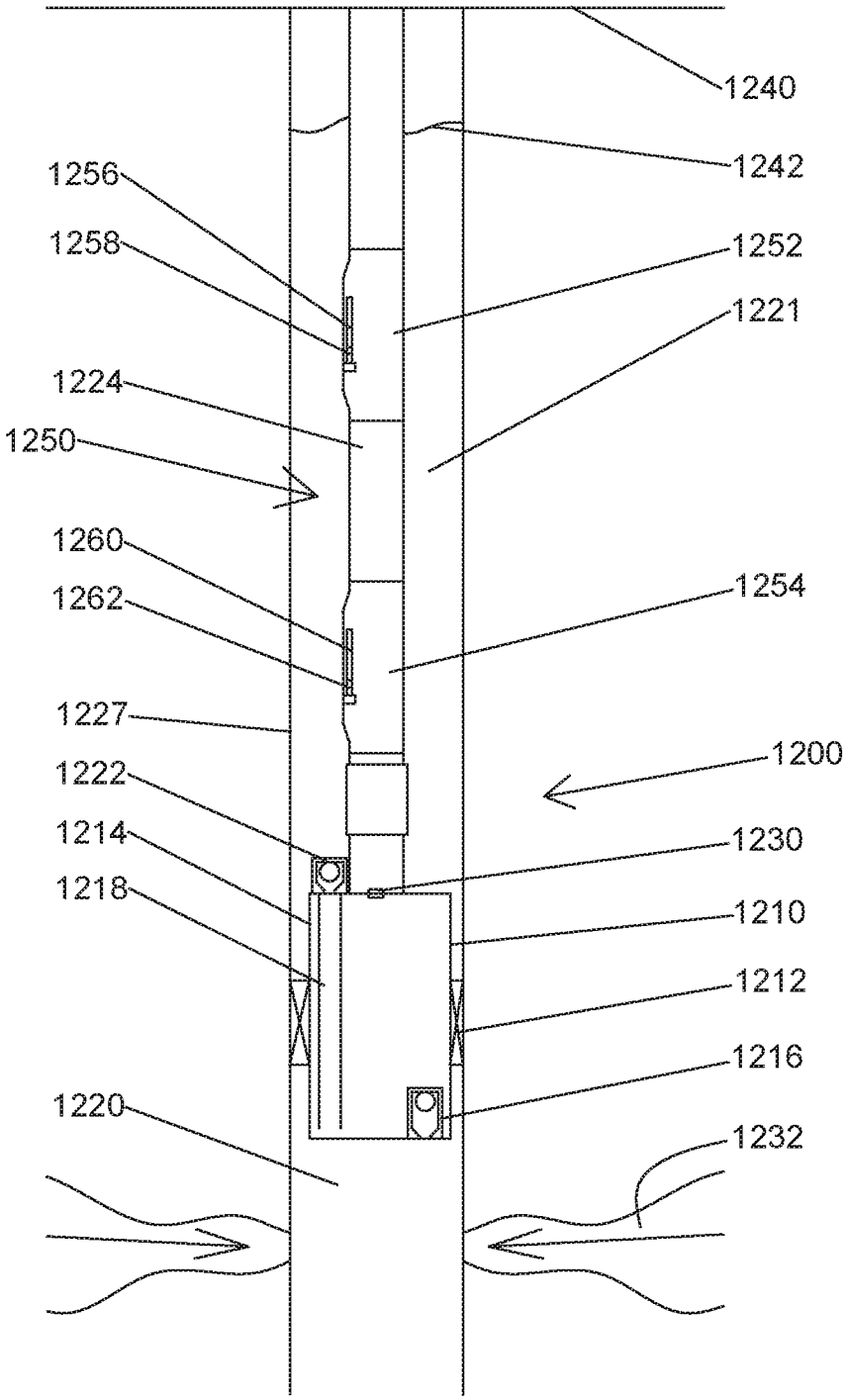
FIG. 12 depicts an alternate embodiment of the hybrid hydraulic gas pump system.

FIG. 12 depicts an alternate embodiment of the hybrid hydraulic gas pump system 1200 where pressurized gas is supplied to both the hybrid hydraulic gas pump 1210 and the gas lift valves 1256 and 1260 via tubular 1224 and is produced to surface via the primary annular area 1221. The hybrid hydraulic gas pump system 200 includes a hybrid hydraulic gas pump 1210. Hybrid hydraulic gas pump 1210 may include a packer such as packer 1212. The packer 1212 is depicted as being adjacent to the hybrid hydraulic gas pump body 1214. The packer 1212 is depicted as sealing the annular area between the hybrid hydraulic gas pump body 1214 and the wellbore wall 1227. The packer 1212 prevents fluid from moving past the hybrid hydraulic gas pump body 1214. Hybrid hydraulic gas pump body 1214 includes a first check valve 1216. The first check valve 1216 allows fluid to flow into the interior of the hybrid hydraulic gas pump body 1214. The first check valve 1216 may be a simple caged ball check valve, a spring-loaded check valve, or other valve that operates to allow fluid to flow into the interior of the hybrid hydraulic gas pump body and then to close on command such as when gas is being allowed into the interior of the hybrid hydraulic gas pump body to force the fluid to the surface. Hybrid hydraulic gas pump body 1214 usually includes a pickup tube 1218.

As shown in FIG. 12 the hybrid hydraulic gas pump 1210 may be considered either not in operation or on an effective fill cycle. The hybrid hydraulic gas pump 1210 is generally mounted as close to formation 1232 as practical. In certain instances, the hybrid hydraulic gas pump 1210 would be mounted below the formation 1232. By locating the hybrid hydraulic gas pump 1210 as close to the formation as practical wellbore fluid is able to move from the formation 1232 to the interior of the hybrid hydraulic gas pump body 1214, even in the absence of significant pressure from the formation. Formation fluid moves from the formation to the lower end of the hybrid hydraulic gas pump 1210. The fluid may then flow into the interior of the hybrid hydraulic gas pump body through check valve 1216, where check valve 1216 allows fluid to move into the interior of the hybrid hydraulic gas pump body 1214 but prevents fluid from moving from the interior of the hybrid hydraulic gas pump body 1214 to the exterior of the hybrid hydraulic gas pump body 1214. As the fluid fills or moves through the interior of the hybrid hydraulic gas pump body 1214 as indicated by arrow 1271 the fluid will also fill pickup tube 1218. Provided there is sufficient pressure from the formation 1232 the fluid will continue to move from the pickup tube 1218 through the upper check valve 1222 and into the primary annular area 1221. Early in the life of the well, pressure from the formation 1232 may be sufficient to push the wellbore fluid all the way to the surface 1240. However, eventually, pressure in the formation 1232 will no longer be sufficient to push fluid to the surface 1240 and will only push fluid part way to the surface, in this instance as shown by the gas fluid interface 1242.

The hybrid hydraulic gas pump system 1200 includes a reverse flow 1250 installed along the length of the tubular 1224 in conjunction with the hybrid hydraulic gas pump 1210. In this instance a first gas lift mandrel 1252 and a second gas lift mandrel 1254 are installed as part of the tubular 1224. A first gas lift valve 1256 is attached to the first gas lift mandrel 1252. Usually, but not always, a gas lift valve has a check valve attached between the gas lift valve in the mandrel. The check valves 1258 and 1262 prevent fluid or other flow from the primary annular area 1221 to the interior of tubular 1224. In this case first check valve 1258 is between the first gas the valve 1256 and the first gas lift mandrel 1252. Also depicted is a second gas lift valve 1260, a second gas lift mandrel 1254, and a second check valve 1262 between the second gas lift valve 1260 and the second gas lift mandrel 1254. As depicted the wellbore fluid has risen to the fluid gas interface 1242 but formation pressure is no longer sufficient to push fluid to the surface 1240.

Figure 13:
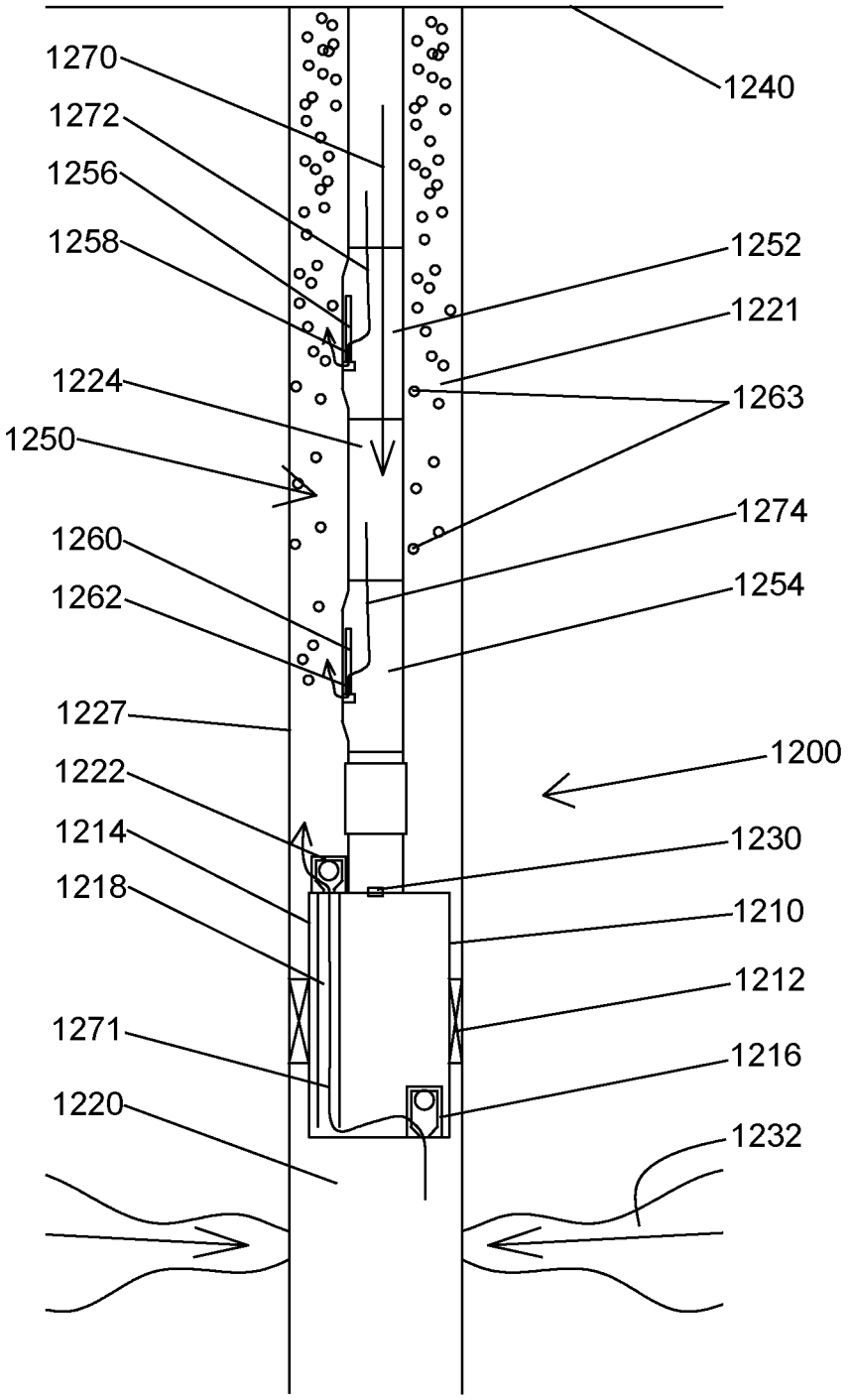
FIG. 13 depicts the gas lift portion of an alternate embodiment of the hybrid hydraulic gas pump system in operation.

FIG. 13 depicts the reverse flow gas lift 1250 portion of the hybrid hydraulic gas pump system 1200 in operation. During this initial stage of gas lift the fluid column within the primary annular area 1221 needs to be lightened in order to allow the formation pressure to push the fluid to the surface 1240. Gas is injected into the primary annular area 1221 as depicted by arrow 1270. As depicted by arrow 1272 injected gas flows from the tubular 1224 through the first gas lift valve 1256, through the first check valve 1258, and into the primary annular area 1221. The gas then becomes interspersed within the wellbore fluid, usually in the form of bubbles such as bubbles 1263. With the bubbles 1263 dispersed within the fluid within the primary annular area 1221 the overall density of the fluid within the primary annular area 1221 is reduced allowing the formation pressure to once again push the fluid to the surface 1240. In certain instances, a single gas lift point such as the first gas lift point provided by first gas lift valve 1256, first check valve 1258, and the first gas lift mandrel 1252 is not able to sufficiently reduce the overall density of the wellbore fluid to allow the fluid to be produced to the surface 1240. Usually, multiple gas lift points are included along the length of the production tubular 1224. A second gas lift point is depicted as being provided by second gas lift valve 1260, second check valve 1262, and second gas lift mandrel 1254. With respect to the second gas lift point, gas flow, as depicted by arrow 1274, flows from the tubular 1224 into the second gas lift valve 1260 through the second check valve 1262 and through the second mandrel 1254 where the gas becomes interspersed within the wellbore fluid. While only two gas lift points are shown multiple gas lift points along the length of the tubular may be utilized.

Eventually formation pressure within reservoir 1232 diminishes to the point where the formation pressure is no longer able to push the fluids to the surface even with gas lift reducing the density of the fluid column. It is envisioned that in such an instance a hybrid hydraulic gas pump 1210 may provide the additional pressure necessary to push the fluid column to the surface 1240 in conjunction with the gas lift system 1250.

Figure 14:
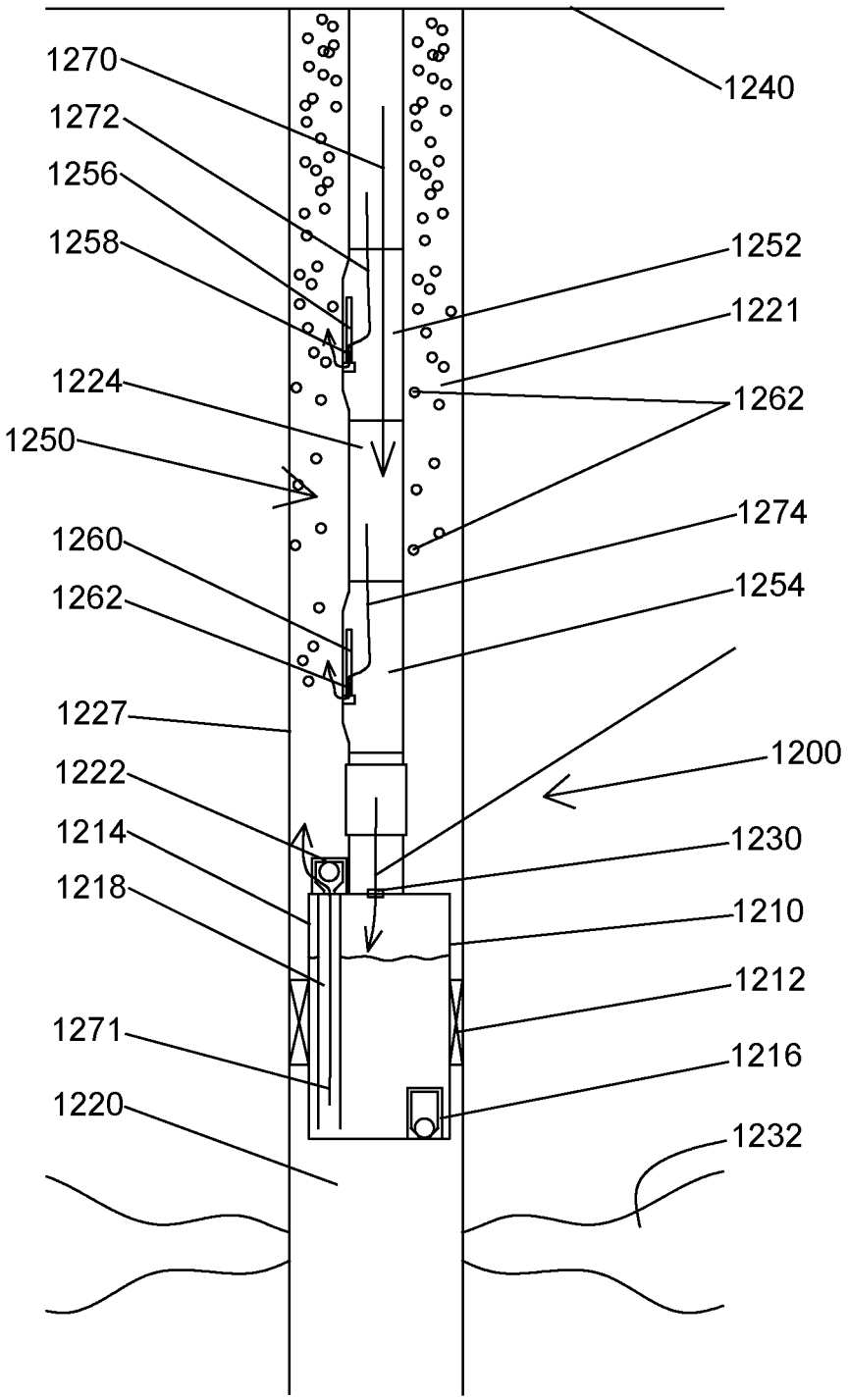
FIG. 14 depicts an alternate embodiment of the hydraulic gas pump system in a mode of operation where the hydraulic gas pump provides the pressure necessary to push the reduced density fluid to the surface.

FIG. 14 depicts the hybrid hydraulic gas pump system 1200 in a mode of operation where the hybrid hydraulic gas pump 1210, replacing the pressure provided by the formation 1232, provides the pressure necessary to push the reduced density fluid to the surface 1240. In this case the reduced density fluid is being created due to the gas lift system 1250 in operation within the wellbore 1220. While in certain instances the hybrid hydraulic gas pump 1210 is capable of providing sufficient pressure to force the wellbore fluid to the surface singly, the use of the gas lift system 1250 to reduce the density of the fluid column reduces the overall energy requirements to move the fluids to the surface as the hybrid hydraulic gas pump 1210 requires less pressure to move the reduced density fluids to the surface as compared to moving the same fluid, but without the injected gas to reduce the density of the fluid, the same distance to the surface 1240. Typically the lowest gas lift point, in this case the gas lift point provided by second gas lift valve 1260, second check valve 1262, and second gas lift mandrel 1254, are placed as close as possible to the hybrid hydraulic gas pump 1210 in order to minimize the amount of full density wellbore fluid between the hybrid hydraulic gas pump 1210 and the second gas lift mandrel 1254. Any full density fluid within production tubular 1224 between gas lift pump 1210 and second mandrel 1254 increases the weight of the fluid column and thus the pressure required to lift the fluid to the surface 1240 and thus increases the amount of energy required to operate the system. The lower the required pressure, the lower the energy cost to lift the fluid to the surface. Generally, the gas pressure is provided by compressors on the surface.

In the hybrid hydraulic gas pump 1210 mode of operation shown in FIG. 14 the gas supply unit 1230 generally includes a valve that opens during the effective pump cycle and closes during the effective fill cycle. The gas supply unit 1230 may operate independently downhole or may be operated from the surface. The gas supply unit 1230 may operate simply on a timed cycle. The timer may be electrical or mechanical. In some instances, the operation of gas supply unit 1230 is based on sensing the fluid level within the hybrid hydraulic gas pump body 1214. The fluid level may be sensed electrically such as by sensing resistance of the fluid or may be mechanical such as having a float within hybrid hydraulic gas pump body 1214 to trigger the gas supply unit 1230 open as the hybrid hydraulic gas pump body 1214 reaches the desired fill level and then triggering the gas supply unit 1230 to close as the fluid level within the hybrid hydraulic gas pump body 1214 reaches the second desired fill level although any sensing mechanism may be used. With the gas supply unit 1230 open, pressurized gas from the tubular 1224 flows from the tubular 1224 through the gas supply unit 1230 and into the interior of the hybrid hydraulic gas pump body 1214. The pressurized gas flowing into the hybrid hydraulic gas pump body 1214 displaces the fluid within the hybrid hydraulic gas pump body from the top down. As the fluid is displaced the first check valve 1216 will close. As additional pressurized gas enters the hybrid hydraulic gas pump body 1214 through the gas supply unit 1230 the fluid within the hybrid hydraulic gas pump body 1214 flows into pickup tube 1218, through the open second check valve 1222 and into primary annular area 1221 where with the assistance of the gas lift system 1250 the fluid is produced to the surface 1240. As the hybrid hydraulic gas pump body 1214 is emptied of fluid the gas supply unit 1230 closes in response to the timer, the fluid sensor, or other signal and the cycle is repeated where as depicted in FIG. 13, the gas supply unit 1230 is shut off and wellbore fluid is allowed to refill the hybrid hydraulic gas pump body 1214 through check valve 1216.

The nomenclature of leading, trailing, forward, rear, clockwise, counterclockwise, right hand, left hand, upwards, and downwards are meant only to help describe aspects of the tool that interact with other portions of the tool.

Plural instances may be provided for components, operations or structures described herein as a single instance. In general, structures and functionality presented as separate components in the exemplary configurations may be implemented as a combined structure or component. Similarly, structures and functionality presented as a single component may be implemented as separate components. These and other variations, modifications, additions, and improvements may fall within the scope of the inventive subject matter.

What is claimed is:

1. An artificial lift system comprising: a production tubular;

a gas lift system having a gas lift mandrel, a gas lift valve; and a first gas supply; and wherein the gas lift system is attached to the production tubular;

a chamber having a first check valve, a second check valve, and is in fluid communication with an intermittent second gas supply line, wherein the first check valve allows fluid to flow into the chamber through the first check valve while preventing fluid from flowing out of the chamber through the first check valve, wherein the second check valve allows fluid to flow out of the chamber through the second check valve while preventing fluid from flowing into the chamber through the second check valve;

wherein the chamber is attached to the production tubular; and wherein the second gas supply line is separate from and positioned within the production tubular.

2. The artificial lift system of claim 1 wherein, the first gas supply is provided via a primary annular region.

3. The artificial gas lift system of claim 1, wherein the first gas supply actuates the gas lift system.

4. The artificial gas lift system of claim 1, wherein the first gas supply reduces a density of a wellbore fluid.

5. The artificial gas lift system of claim 1, wherein the second gas supply line strokes the chamber.

6. An artificial lift system comprising:

a production tubular;

a gas lift system having a gas lift mandrel, a gas lift valve; and an annular gas supply; and wherein the gas lift system is attached to the production tubular;

a chamber having a first check valve, a second check valve, and is in fluid communication with the annular gas supply, wherein the first check valve allows fluid to flow into the chamber through the first check valve while preventing fluid from flowing out of the chamber through the first check valve, wherein the second check valve allows fluid to flow out of the chamber through the second check valve while preventing fluid from flowing into the chamber through the second check valve;

wherein the chamber is attached to the production tubular;

further comprising a gas supply unit wherein the gas supply unit permits the annular gas supply to stroke actuate the chamber;

wherein the gas supply unit further comprises a fluid level sensor; and wherein the gas supply unit closes in response to the fluid sensor.

7. The artificial lift system of claim 6 wherein, the fluid level sensor is mechanical.

8. The artificial lift system of claim 6 wherein, the fluid level sensor is electrical.

* * * * *